United States Patent [19]

Romer et al.

[11] 4,342,262

[45] Aug. 3, 1982

[54] CARRIER MISSILE FOR EJECTABLE BODIES

[75] Inventors: Rudolf Romer, Kaarst; Rolf Hellwig; Dietmar Karius, both of Düsseldorf, all of Fed. Rep. of Germany

[73] Assignee: Rheinmetall GmbH, Düsseldorf, Fed. Rep. of Germany

[21] Appl. No.: 772,550

[22] Filed: Feb. 22, 1977

[30] Foreign Application Priority Data

Feb. 23, 1976 [DE] Fed. Rep. of Germany ..... 2607336

[51] Int. Cl.[3] ..... F42B 13/50

[52] U.S. Cl. ..... 102/489; 102/393

[58] Field of Search ..... 102/6, 7.2, 34.4, 35.6, 102/37.6, 66–69, 89 CD, 90, 489, 393, 394, 340, 351, 357, 513, 473, 491, 493, 364, 367

[56] References Cited

U.S. PATENT DOCUMENTS

| | | | |
|---|---|---|---|
| 3,023,703 | 3/1962 | Beatty | 102/49.4 |
| 3,712,229 | 1/1973 | Schock | 102/69 |
| 3,956,990 | 5/1976 | Rowe | 102/69 |

FOREIGN PATENT DOCUMENTS

| | | | |
|---|---|---|---|
| 2043824 | 3/1972 | Fed. Rep. of Germany | 102/69 |
| 2352576 | 5/1974 | Fed. Rep. of Germany | 102/69 |

*Primary Examiner*—Harold J. Tudor

*Attorney, Agent, or Firm*—Montague & Ross

[57] ABSTRACT

A subcaliber missile to be launched from a barrel, in order to serve as a carrier for satellite missiles of other ejectable bodies, has an envelope divided into two half-shells of tapering configuration which are articulated to the missile bottom and are held together by a missile head and by internal partitions separating the ejectable bodies from one another. When the missile is in flight, the ejection of the head by the detonation of a charge exerts a backward reaction force upon the envelope, causing its load to move forward therein whereby the partitions are disengaged from the two half-shells and allow them to flip apart. The half-shells are provided with slots for a recessed tail-wing assembly and with back fins which, like the missile bottom, conform to the caliber of the barrel.

7 Claims, 3 Drawing Figures

CARRIER MISSILE FOR EJECTABLE BODIES

FIELD OF THE INVENTION

Our present invention relates to a carrier missile for ejectable bodies, such as satellite missiles, mines or the like, consisting of a split missile envelope designed to receive several aligned bodies, resting against partitions, which upon traverse of a certain flight path are released by the castoff of the head and the flipping-open of the missile envelope.

BACKGROUND OF THE INVENTION

The construction of the known carrier missiles is determined essentially by the shape of the satellite missiles; thus, carrier missiles classified according to weapon and caliber as pertaining to a certain missile family frequently deviate in their shape from that family to such an extent that, as a rule, they are considered special ammunition. This means, in turn, that separate propulsion charges or cartridges must be provided for them which are to be employed according to a firing table specifically established for the carrier missiles.

OBJECTS OF THE INVENTION

An object of our invention is to provide, with avoidance of the drawbacks referred to, carrier missiles for ejectable bodies which, starting from a simple basic concept, enable a series of modifications without leaving the frame of the missile family. This means that they may be fired from the same type of barrel and with the same type of propulsion charges and with the firing tables applicable to standard missiles.

Another object resides in so designing the carrier missiles that they can receive without modification, as payload, an optimum number of the bodies to be ejected and that no free-flying parts are left over upon the ejection of the payload.

SUMMARY OF THE INVENTION

This problem is solved, according to the invention, by a missile envelope formed from half-shells which is hingedly connected with the missile bottom, with a cylindrical interior and with an exterior converging conically toward the missile point, whose inner wall is provided with spaced-apart annular grooves receiving several partitions individually supporting the bodies to be ejected, which in turn engage with their ends in the annular grooves in such a way that upon launching they clamp the two half-shells of the missile envelope together but release them upon the ejection of the bodies.

According to the invention, each annular groove is provided with an undercut extending toward the missile bottom in which the downwardly deformed rim of the partition engages in claw-like fashion. The breadth of the annular groove is so chosen that the partition is removable by axial displacement from the undercut.

Furthermore, the half-shells of the missile envelope are additionally held together by the missile head which latter is detachably connected with the missile envelope by shearing pins.

The missile envelope is provided in its forward, externally reduced region with several guide fins corresponding to the barrel caliber.

The ejection of the bodies is carried out by an ejection charge disposed in the missile head whereby, upon ignition, the missile head is detachable and the missile envelope with its half-shells is flippable into an open position about the missile bottom.

Finally, pursuant to another feature of our invention, the carrier missile can be used as a wing-stabilized subcaliber missile by providing the missile envelope in the region of the missile bottom, which has the caliber of the barrel, with a spring-loaded flipping empennage whose tail wings are countersunk in the missile envelope.

The advantages of this carrier missile reside in that, thanks to the simple supporting structure, a multiplicity of bodies can be lodged therein, that the bodies themselves can be received without modification and that the weight of the missile can nevertheless be regarded as favorable. The high economy of the carrier missile is further reflected in the simple manipulation and good handlability and, last but not least, in the fact that within the region of the flipping linkage with its countersunk wings it is not necessary to forgo the emplacement of a payload.

BRIEF DESCRIPTION OF THE DRAWING

An embodiment of our invention will be more fully described hereinafter with reference to the accompanying drawing in which.

SPECIFIC DESCRIPTION

Figure 1:
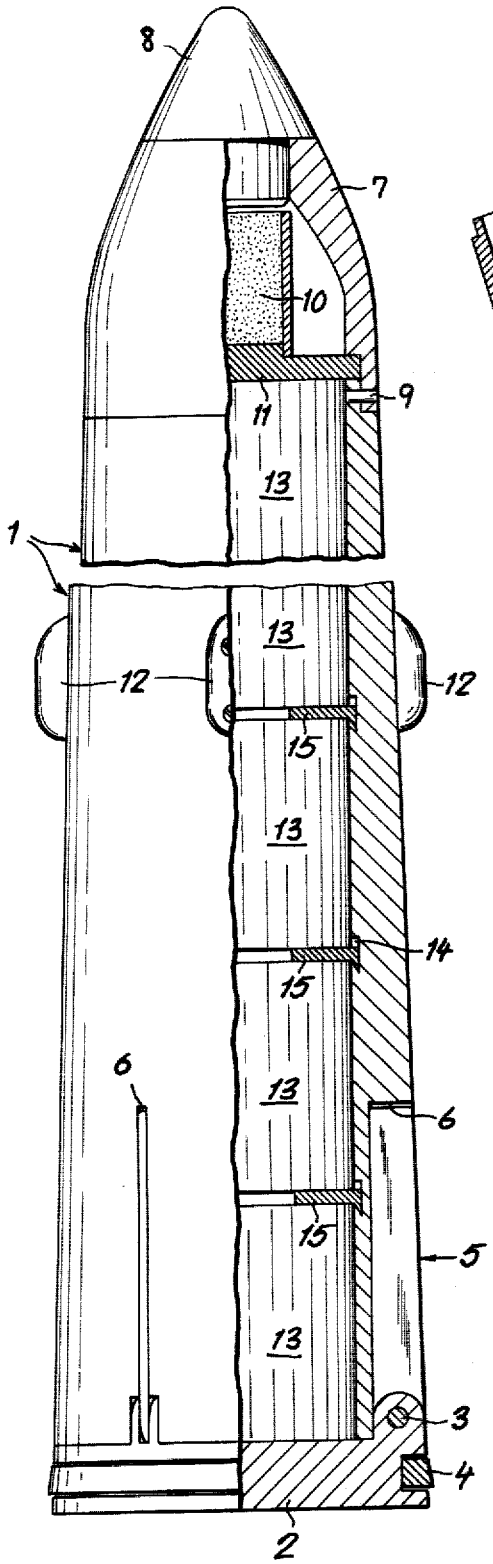
FIG. 1 shows a wing-stabilized subcaliber missile partly in view and in longitudinal section.

The wing-stabilized subcaliber missile consists of a missile envelope 1, composed of half-shells 1*a* and 1*b*, whose inner wall is cylindrical and whose outer wall is conically tapered. In the region of the missile bottom 2, with which the half-shells 1*a* and 1*b* are articulatedly connected by means of hinges 3, the missile envelope has its largest cross-section. The missile bottom 2 corresponds to the barrel caliber and is provided with a sliding guide strap 4 when the missile is equipped with an empennage. The flipping empennage 5 here utilized consists of several spring-loaded wings 5*a* countersunk in respective longitudinal slots 6 of the missile envelope. The wings 5*a* are urged by small springs (not shown), surrounding their axles, into their spread-apart position. They are held together until the launching of the missile from the weapon barrel, e.g. by elastic tapes surrounding the missile envelope 1 in the region of the flipping empennage 5.

The half-shells 1*a* and 1*b* of the missile envelope 1 are initially held together, with the aid of several radial shear pins 9, by the emplaced missile head 7 which contains an igniter 8 at its point. Immediately adjacent the igniter 8 there is disposed an ejection charge 10 bearing upon a massive partition 11. For the guidance or centering of the missile in the weapon barrel, the missile is provided in its reduced forward region with several guiding fins 12 whose periphery conforms to the barrel caliber.

The entire interior of the missile serves for the reception of a payload in the form of satellite missiles, mines and the like which, according to their mode of use, reach the ground upon ejection from the missile envelope 1 in a free fall or suspended from a parachute.

In order to insure that the bodies 13 serving as the payload, which themselves may be provided with highly disruptive ignition and explosion means, not be damaged—let alone detonated—upon ejection from the missile envelope, provision is made for relieving them individually of the launching pressure by means of partitions.

For this purpose the inner wall of the missile envelope 1 is provided with spaced-apart annular grooves 14 formed with undercuts 14*a* facing toward the missile bottom 2. The annular grooves 14 serve to receive stable partitions 15 whose downwardly deformed rims 15*a* engage in claw-like fashion in the undercuts 14*a*. In order to facilitate the insertion of the partitions 15 and also their removal from the annular grooves 14, the breadth of the annular grooves 14 is so chosen that the inner width of the annular-groove aperture is somewhat larger than the width of the outer edge of the partition 15 with its extended rim 15*a*.

The operation is as follows:

Upon launching, the entire payload of the missile is immobilized thanks to the supporting function of the partitions 15. The sliding guide strap 4 prevents the full transmission of the twist to the missile if the latter is launched from a rifled weapon barrel. The elastic tape retaining the tail wings 5*a* of the flipping empennage 5, or an equivalent other means, is deactivated upon the passage through the barrel so that the flipping empennage 5 can open after leaving the barrel muzzle and can assume the stabilization of the flight. The missile now continues its flight until the igniter 8, set to a predetermined flight time, detonates the ejection charge 10. This ruptures the shearing pins 9 so that the entire missile head 7 with igniter 8 is cast off. The extremely massive partition 11, sitting loose on the missile envelope 1, prevents any pressure transmission to the payload.

Figure 2:
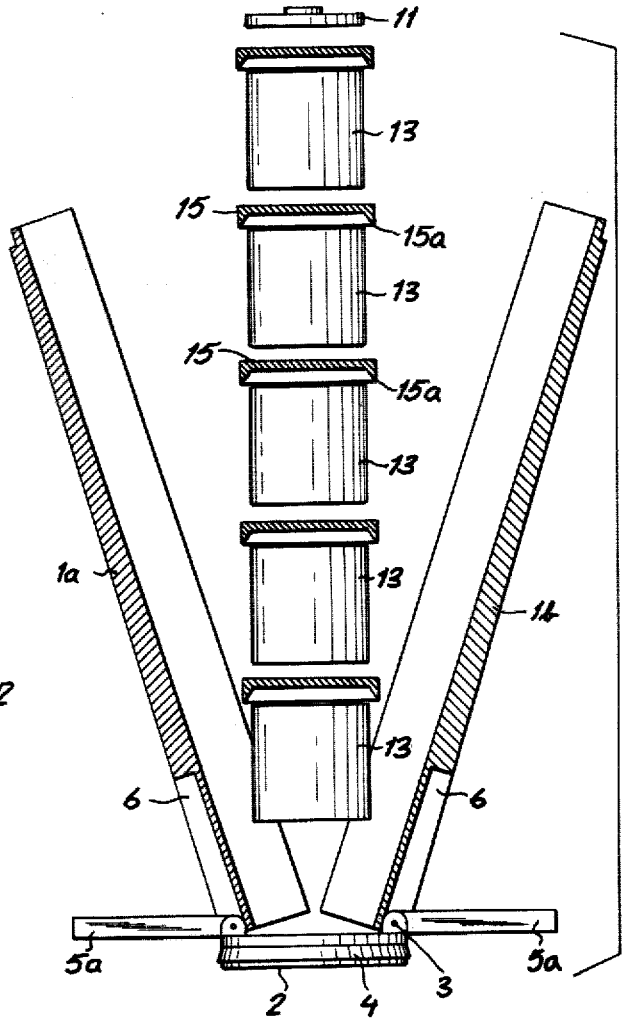
FIG. 2 shows in section the missile of FIG. 1 following detachment of the missile head and flipping-open of the missile envelope.
Figure 3:
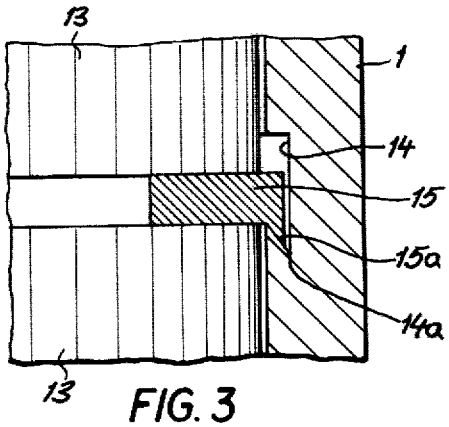
FIG. 3 shows, on a larger scale and in section, the emplacement of the partition in an annular groove of the missile envelope.

The missile is suddenly and sharply decelerated by the ejection so that the entire payload together with the partitions 15 is shifted toward the missile point. This releases the partitions 15 so that the half-shells 1*a* and 1*b* of the missile envelope 1 can tilt outwardly about the hinges 3. This position is shown in FIG. 2. Since the flipped-open missile envelope 1 with the missile bottom 2 presents a large resistance to the air, the missile rump lags behind the payload and drops to the ground. The payload consisting of several bodies 13 stays together in a predetermined order. As a result, the payload goes into action with the combined effect of the individual bodies 13.

We claim:

1. A carrier missile for ejectable bodies such as satellite missiles, mines and the like, adapted to be launched from a barrel, comprising a split missile envelope provided with a bottom and a head, designed to receive several aligned bodies, resting against partitions, which upon traverse of a certain flight path are released by the castoff of the missile head and the flipping-open of the missile envelope, said missile envelope being formed from half-shells and hingedly connected with the missile bottom, with a cylindrical interior and with an exterior converging conically toward the missile point, whose inner wall is provided with spaced-apart annular grooves receiving several partitions, individually supporting the bodies to be ejected, which in turn engage with their ends in the annular grooves in such a way that upon launching they clamp the half-shells of the missile envelope together but release them upon the ejection of the bodies.

2. A carrier missile according to claim 1 wherein each annular groove is provided with an undercut extending toward the missile bottom in which a downwardly deformed rim of the respective partition engages in claw-like fashion.

3. A carrier missile according to claim 2 wherein the breadth of the annular grooves is so chosen that the partitions are removable by axial displacement from the undercut.

4. A carrier missile according to claim 1 wherein the half-shells of the missile envelope are additionally held together by said head which is detachably connected with the missile envelope by shearing pins.

5. A carrier missile according to claim 1 wherein the missile envelope is provided in its forward, externally reduced region with several guide fins corresponding to the barrel caliber.

6. A carrier missile according to claim 1 wherein the ejection of the bodies is carried out by an ejection charge disposed in the missile head whereby, upon ignition, the missile head is detachable and the missile envelope with its half-shells is flippable into an open position about the missile bottom.

7. A carrier missile for use as a wing-stabilized subcaliber missile according to claim 1 wherein the missile envelope is provided in the region of the missile bottom, which has the caliber of the barrel, with a spring-loaded flipping empennage whose wings are countersunk in the missile envelope.

* * * * *